US008770924B2

(12) United States Patent
Beeck et al.

(10) Patent No.: US 8,770,924 B2
(45) Date of Patent: Jul. 8, 2014

(54) GAS TURBINE ENGINE WITH ANGLED AND RADIAL SUPPORTS

(75) Inventors: Alexander Beeck, Orlando, FL (US); Malberto Gonzalez, Orlando, FL (US); Jerome H. Katy, Palm Beach Gardens, FL (US); David J. Wiebe, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 512 days.

(21) Appl. No.: 13/177,701

(22) Filed: Jul. 7, 2011

(65) Prior Publication Data

US 2013/0011242 A1 Jan. 10, 2013

(51) Int. Cl.
*F01D 25/16* (2006.01)

(52) U.S. Cl.
USPC ..... 415/142; 415/213.1

(58) Field of Classification Search
USPC ..... 415/142, 182.1, 213.1, 108, 211.2
See application file for complete search history.

(56) References Cited

U.S. PATENT DOCUMENTS 2,616,662 A 11/1952 Mierley
2,869,941 A 1/1959 Shoup, Jr. et al.
2,941,781 A 6/1960 Boyum
4,013,377 A 3/1977 Amos
4,135,362 A 1/1979 Glenn
4,478,551 A * 10/1984 Honeycutt et al. ..... 415/142
4,965,994 A 10/1990 Ciokajlo et al.
4,979,872 A 12/1990 Myers et al.
4,987,736 A * 1/1991 Ciokajlo et al. ..... 60/797
5,076,049 A 12/1991 Von Benken et al.
5,080,555 A 1/1992 Kempinger
5,160,251 A * 11/1992 Ciokajlo ..... 415/142
5,483,792 A 1/1996 Czachor et al.
5,941,683 A 8/1999 Ridyard et al.
6,679,045 B2 1/2004 Karafillis et al.

* cited by examiner

*Primary Examiner* — Edward Look
*Assistant Examiner* — William Grigos

(57) ABSTRACT

A support structure in a gas turbine engine including an inner annular wall and an outer annular wall defining an annular flow path, a casing housing the structure defining the flow path, and a bearing compartment housing a rotor shaft bearing located radially inwardly from the inner annular wall. The support structure includes a plurality of circumferentially spaced radial support members extending radially inwardly from an outer mount connection at the casing to an inner mount connection at the bearing compartment housing. The radial support members provide structural support for radial bearing loads on the rotor shaft bearing. A plurality of circumferentially spaced axial support members extend radially and axially inwardly from an outer mount connection at the casing to an inner mount connection located on an annular structure extending radially between connection locations at the bearing compartment housing and the inner annular wall.

20 Claims, 5 Drawing Sheets

GAS TURBINE ENGINE WITH ANGLED AND RADIAL SUPPORTS

FIELD OF THE INVENTION

The present invention relates to gas turbine engines and, more particularly, to structure supporting a radially inner structure relative to a radially outer casing of the engine.

BACKGROUND OF THE INVENTION

In gas turbine engines, a radially inner structure, such as a bearing housing, may be supported relative to an outer casing of the engine by radially extending struts. The struts may be welded to the outer casing and extend radially through an outer duct structure defining an outer boundary for a hot working gas flow path, pass through the flow path, and extend through an inner duct structure defining a boundary for the flow path to a welded attachment location on the bearing housing. Since such a structure is formed as a welded structure, repairs typically necessitate cutting out parts of the structure and welding in new structure.

Alternatively, the bearing housing may be supported relative to the outer casing by tie rods extending radially from the outer casing to the bearing housing to radially locate the bearing housing. While such a radial rod support structure may provide good load transfer in the radial direction, such a structure typically does not provide substantial support against axial loads applied to the bearing housing.

SUMMARY OF THE INVENTION

In accordance with an aspect of the invention, a support structure is provided for use in a gas turbine engine having structure defining an annular flow path including an inner annular wall and an outer annular wall, a casing for housing the structure defining the flow path, and a bearing compartment housing a rotor shaft bearing located radially inwardly from the inner annular wall. The support structure comprises a plurality of circumferentially spaced radial support members extending radially inwardly from an outer mount connection at the casing to an inner mount connection at the bearing compartment housing. The radial support members provide structural support for radial bearing loads on the rotor shaft bearing. A plurality of circumferentially spaced axial support members extend radially and axially inwardly from an outer mount connection at the casing to an inner mount connection located on an annular structure extending radially between connection locations at the bearing compartment housing and the inner annular wall.

In accordance with another aspect of the invention, a support structure is provided for use in a gas turbine engine having structure defining an annular flow path including an inner annular wall and an outer annular wall, a casing for housing the structure defining the flow path, and a bearing compartment housing a rotor shaft bearing located radially inwardly from the inner annular wall. The support structure comprises a plurality of circumferentially spaced radial support members extending radially inwardly from an outer mount connection at the casing to an inner mount connection at the bearing compartment housing. The radial support members provide structural support for radial bearing loads on the rotor shaft bearing. A plurality of circumferentially spaced axial support members extend radially and axially inwardly from an outer mount connection at the casing to an inner mount connection located on a diaphragm extending radially between connection locations at the bearing compartment housing and the inner annular wall. The axial support members comprise tie rods operating in tension to counteract a pressure force applied against the diaphragm.

In accordance with further aspects of the invention, the radial support members may comprise tie rods releasably attached to the casing and to the bearing compartment housing. Alternatively, the radial support members may comprise support struts rigidly affixed to the casing and to the bearing compartment housing.

The axial support members may comprise fastener connections retaining ends of the tie rods to the casing and to the bearing compartment housing. The axial support members may extend from the casing at an angle directed rearwardly relative to the radial support members.

The radial support members may define an imaginary surface of revolution extending around the axis of the engine, and the axial support members may intersect the surface of revolution at a location adjacent to the casing. Additionally, the axial support members may intersect the surface of revolution at a location radially inwardly from the casing.

A plurality of aerodynamic vanes may extend between the outer annular wall and the inner annular wall, wherein at least one of each of the radial and axial support members may be enclosed within each of the vanes.

The diaphragm may be provided to separate a higher pressure turbine section of the engine from a lower pressure section of the engine.

The axial support members may engage the diaphragm at a location between the bearing compartment housing and the inner annular wall to resist axial pressure forces exerted against the diaphragm.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
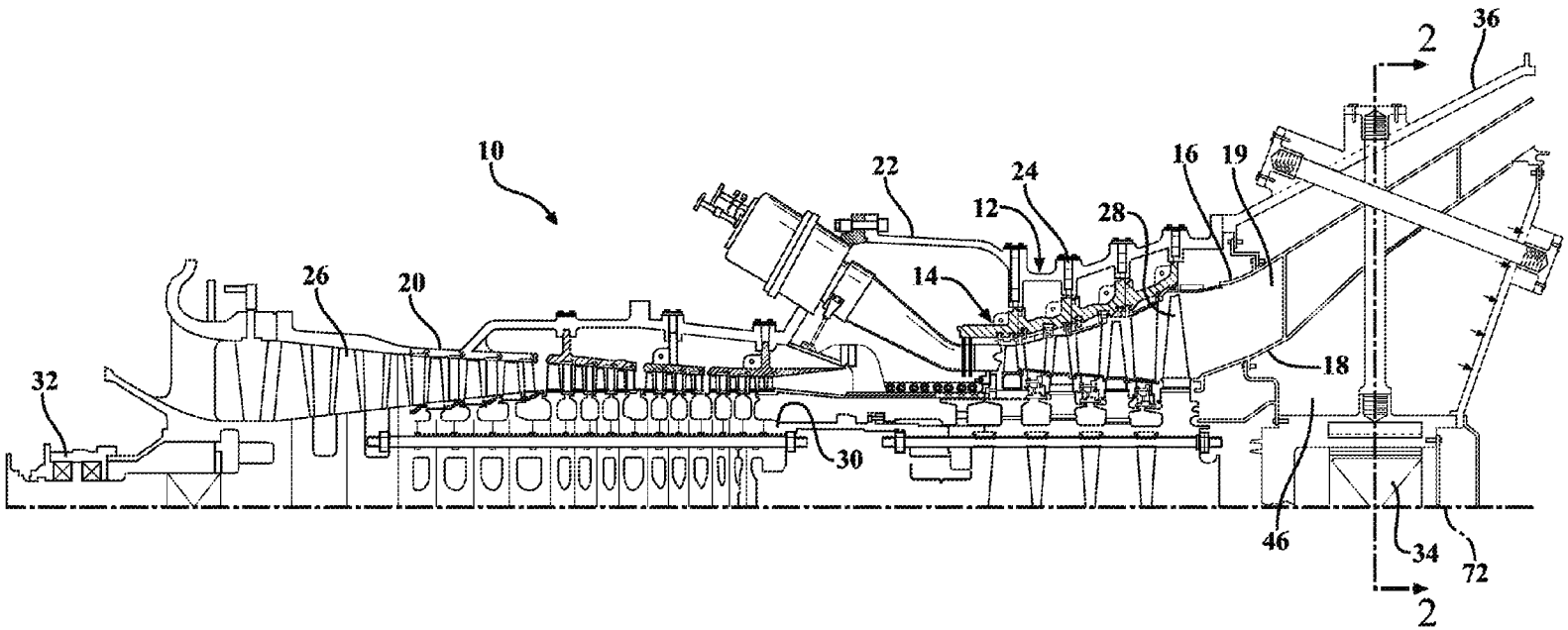
FIG. 1 is a diagrammatic cross-sectional view of a gas turbine engine incorporating the present invention.

Referring to FIG. 1, a turbine engine 10 is diagrammatically illustrated comprising a cylindrical outer casing 12 having mounted therein an inner structure 14 which includes an outer annular wall 16 and an inner annular wall 18 defining an annular flow path 19 through the engine 10. Contained within the outer casing 12 are a compressor section 20, a combustor section 22 and a turbine section 24. A rotor shaft 30 is mounted in axial alignment within the outer casing 12 and supports a bladed rotor 26 of the compressor section 20 and a bladed rotor 28 of the turbine section 24. The rotor shaft 30 is supported for rotation on bearing assemblies, such as on a front bearing assembly 32 and a rear bearing assembly 34.

The compressor section 20 provides compressed air to the combustor section 22 where the compressed air and a fuel are mixed and combusted to produce a hot working gas. The hot working gas is provided to the turbine section 24 where the working gas is expanded to produce a work output, and at least a portion of the turbine section output may be used to power the compressor section 20. The illustrated turbine engine 10 may comprise, for example, an aero-derivative engine where the turbine section 24 comprises a high pressure turbine, and a further lower pressure turbine, such as a power turbine (not shown), may be provided at a downstream location. Hence, an exhaust passage from the turbine section 24 may comprise a transition section 36 defined by a portion of the outer and inner walls 16, 18 for conveying the expanded working gas from the turbine section 24 to the low pressure turbine.

Figure 3:
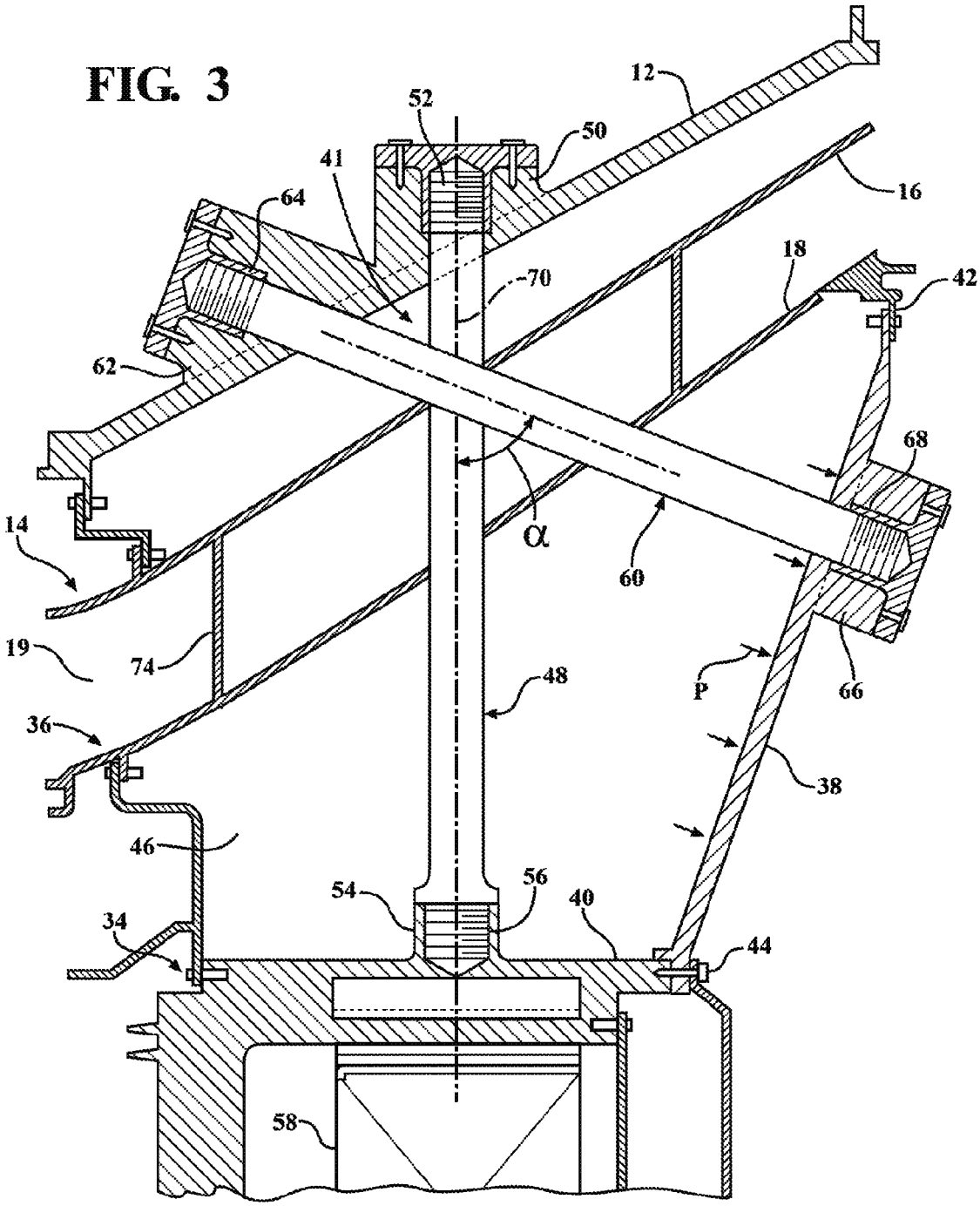
FIG. 3 is an enlarged view of a portion of FIG. 1 illustrating a support structure according an aspect of the present invention.

Referring further to FIG. 3, the inner structure 14 of the engine 10 additionally includes an annular structure or diaphragm 38 extending between the inner wall 18 and a bearing compartment housing 40 of the rear bearing assembly 34, and may be angled rearwardly in a radially outward direction. The diaphragm 38 closes off a downstream end of the high pressure turbine section 24 and comprises a substantially continuous annular structure extending generally radially between an outer connection point 42 at the inner wall 18 and an inner connection point 44 at the bearing compartment housing 40. The connection points 42, 44 may comprise detachable connection points, such as may be formed by fastener connections. The annular structure of the diaphragm 38 may form a wall for a pressurized buffer cooling air supplied to an inner diameter cavity 46 within the outer casing 12, such as bleed cooling air provided to the inner diameter cavity 46 from one or more stages of the compressor section 20. The diaphragm 38 and bearing housing compartment 40 are supported by a support structure 41, including radial support members 48 and axial support members 60, as is described further below.

Figure 2:
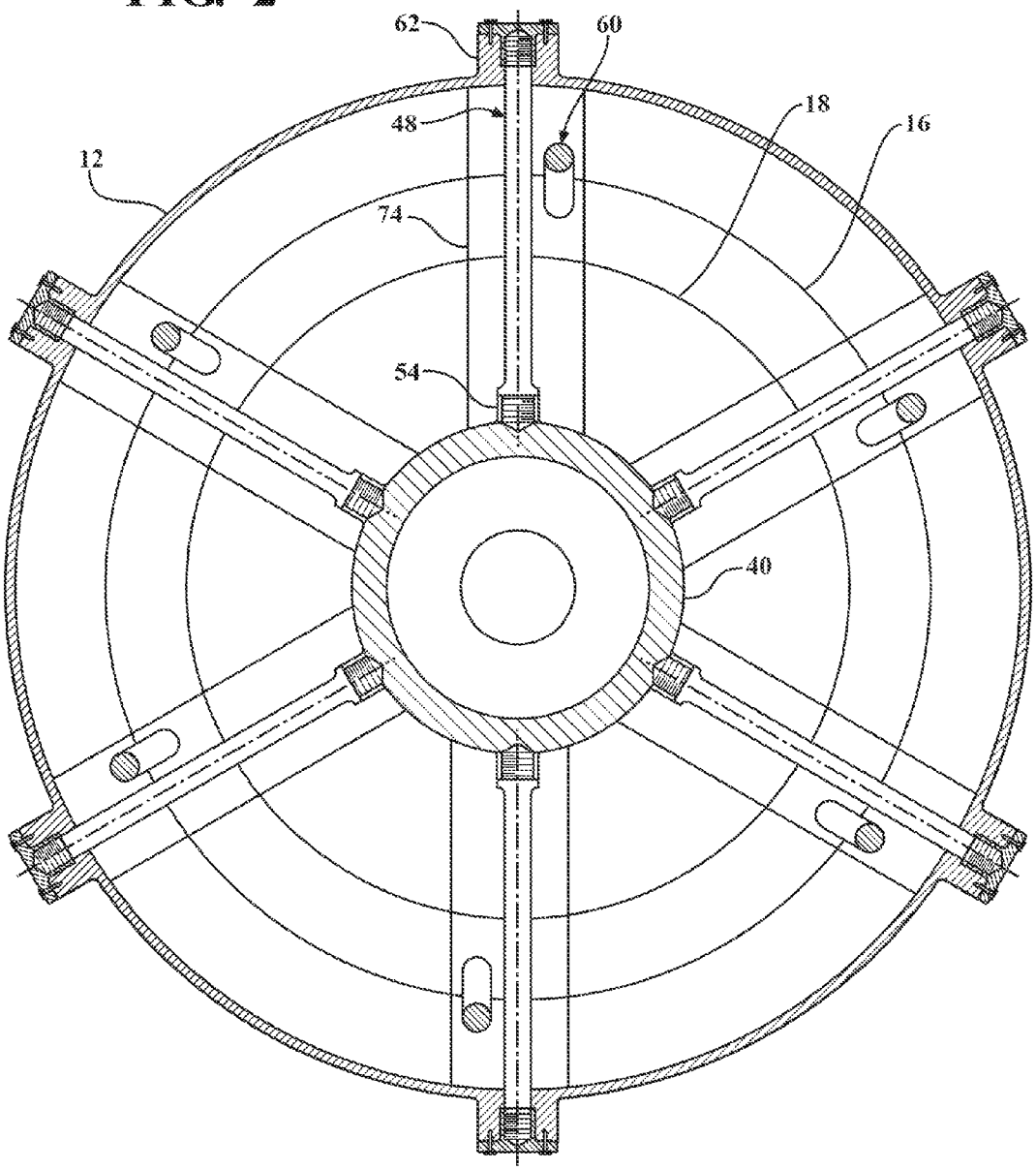
FIG. 2 is a cross-sectional view taken along line 2-2 in FIG. 1.

In accordance with an aspect illustrated in FIGS. 2 and 3, the bearing housing compartment 40 may be supported and located radially within the outer casing 12 by the radial support members 48. A plurality of the radial support members 48 may be circumferentially spaced about a central axis 72 (FIG. 1) of the engine 10 and may comprise a plurality of tie rods that preferably operate in tension to support the bearing housing compartment 40. The radial support members 48 may be rigidly affixed to the outer casing 12 at a radially outer mount connection 50 which may comprise a fastener connection 52, such as a threaded rod connection of any known construction, to removably mount the radial support member 48 to the outer casing 12.

An opposite end of the radial support members 48 may be rigidly affixed to the bearing housing compartment 40 at a radially inner mount connection 54 which may comprise a fastener connection 56, such as a threaded rod connection of any known construction, to removably mount the radial support member 48 to the bearing housing compartment 40. The bearing housing compartment 40 may comprise any structure supporting a bearing 58 at a rear or exhaust portion of the turbine section 24, such as structure engaged with an outer race of the bearing 58.

In accordance with another aspect of the invention, a plurality of the axial support members 60 may be circumferentially spaced about the central axis 72 of the engine 10 and may extend at an angle radially and axially inwardly from the outer casing 12 to the diaphragm 38. The axial support members 60 may comprise tie rods rigidly affixed to the outer casing 12 at an axially forward mount connection 62 which may comprise a fastener connection 64, such as a threaded rod connection of any known construction, to removably mount the axial support member 60 to the outer casing 12. An opposite end of the axial support members 60 may be rigidly affixed to the diaphragm 38 at an axially rearward mount connection 66 which may comprise a fastener connection 68, such as a threaded rod connection of any known construction, to removably mount the axial support member 60 to the diaphragm 38.

The axial support members 60 extend from the outer casing 12 directed rearwardly an angle relative to the radial support members 48. For example, the axial support members 60 may form an acute angle $\alpha$ with the radial support members 48 generally within a range of about 30° to about 80°. More particularly, the acute angle $\alpha$ may more preferably be within a range of about 55° to about 70°. It may be noted that, to the extent that it is practical, it is preferable that the axial support members 60 intersect the diaphragm 38 at or about an angle of 90°, such that forces are transmitted to the axial support members 60 substantially parallel to the axis of the axial support members 60.

As seen in FIG. 3, the radial support members 48 may be characterized as defining an imaginary surface of revolution, depicted by line 70, extending radially outwardly around the central axis 72 (FIG. 1) of the engine 10, and the axial support members 60 may be positioned and oriented such that they intersect the surface of revolution 70 at a location adjacent to the casing 12. For example, in the illustrated embodiment, the axially forward mount connections 62 may be located at the outer casing 12 forwardly of the radially outer mount connections 50 for the radial support members 48, and the axially rearward mount connections 66 may be located at a location on the diaphragm 38 radially between the outer connection point 42 at the inner wall 18 and the inner connection point 44 at the bearing housing compartment 40. Hence, the axial support members 60 may intersect the surface of revolution 70 at a location radially inwardly from the outer casing 12.

The axial support members 60 may preferably operate in tension to provide a support for the diaphragm 38. In particular, the axial support members 60 may counteract a generally axial downstream pressure load, depicted by arrows P in FIG. 3, such as a pressure load that may be applied by pressurized buffer cooling air within the inner diameter cavity 46. The support provided by the axial support members 60 may reduce flexing and stresses in the diaphragm 38, as well as reduce axial loads that may be transferred from the diaphragm 38 to the bearing housing compartment 40. The axial support members 60 may further reduce or eliminate axial loads that may be transferred to the flow path liner, e.g., the inner wall 18, or to other flow path structure (not shown) located downstream from the inner wall 18 and connection 42.

It should be noted that the radial support members 48 and axial support members 60 are preferably pre-tensioned for the static and dynamic load requirements associated with the bearing housing compartment 40 and the diaphragm 38. For example, the radial and axial support members 48, 60 may be simultaneously pre-tensioned to provide a predetermined pre-load for supporting the bearing compartment housing 40 and the diaphragm 38.

The radial support members 48 and axial support members 60 may pass through both the outer and inner walls 16, 18, extending through the flow path 19, substantially adjacent to each other, as seen in FIG. 2. A housing or aerodynamic vane 74 may be provided surrounding each pair of the radial and axial support members 48, 60 to provide an aerodynamic contour for passage of the working gas past the support members 48, 60, and to isolate the support members 48, 60 from direct thermal contact with the working gas. Alternatively, the support members 48, 60 may be circumferentially spaced from each other, or fewer or more of the axial support members 60 may be provided than the number of radial support members 48.

Figure 5A:
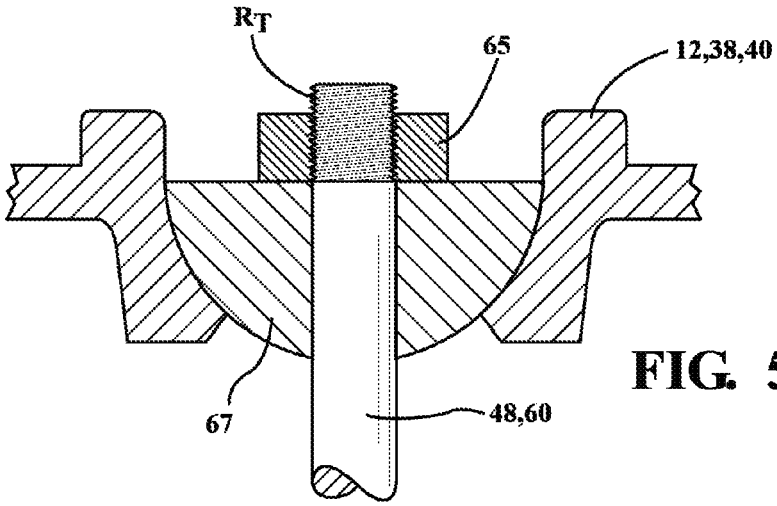
FIGS. 5A-C illustrate exemplary tie rod ends for support members of the support structure.
Figure 5B:
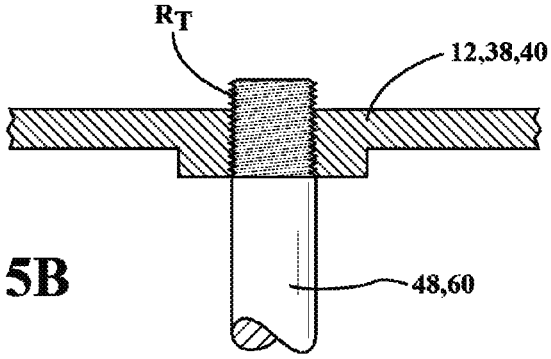
Figure 5C:
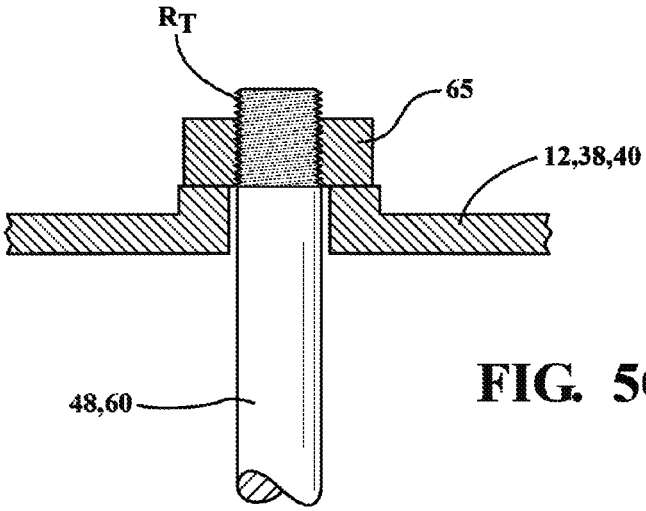

Examples of tie rod ends that may be provided to one or both of the support members 48, 60 include, for example and without limitation, a threaded rod end $R_T$ having a nut 65 cooperating with a spherical boss 67 engaged in a socket on a respective structural member i.e., the outer casing 12, the diaphragm 38, and/or the bearing housing compartment 40, to apply tension through the support member 48, 60, see FIG. 5A; a threaded rod end $R_T$ engaged within a threaded hole in a respective structural member to apply tension through the support member 48, 60, see FIG. 5B; or a threaded rod end $R_T$ having a nut 65 cooperating with a respective structural member, to apply tension through the support member 48, 60, see FIG. 5C. In the tie rod end illustrated in FIG. 5B, it should be noted that a feature, such as one or more generally flat surfaces formed in or around the threaded rod end $R_T$, may be provided to permit a tool to grip and rotate the support member 48, 60 within the threaded hole.

The detachable assembly provided by the fastener connections at the ends of the radial and axial support members 48, 60 may be used to facilitate assembly and disassembly of the support members 48, 60 to the outer casing 12 and to the bearing housing compartment 40 and the diaphragm 38, respectively. Further, provision of tie rods for the axial support members 60 may enable a predetermined pre-load to be applied to the diaphragm 38, such as a preload applied with reference to an anticipated buffer air pressure and/or an axial force exerted at the bearing compartment housing 40.

Figure 4:
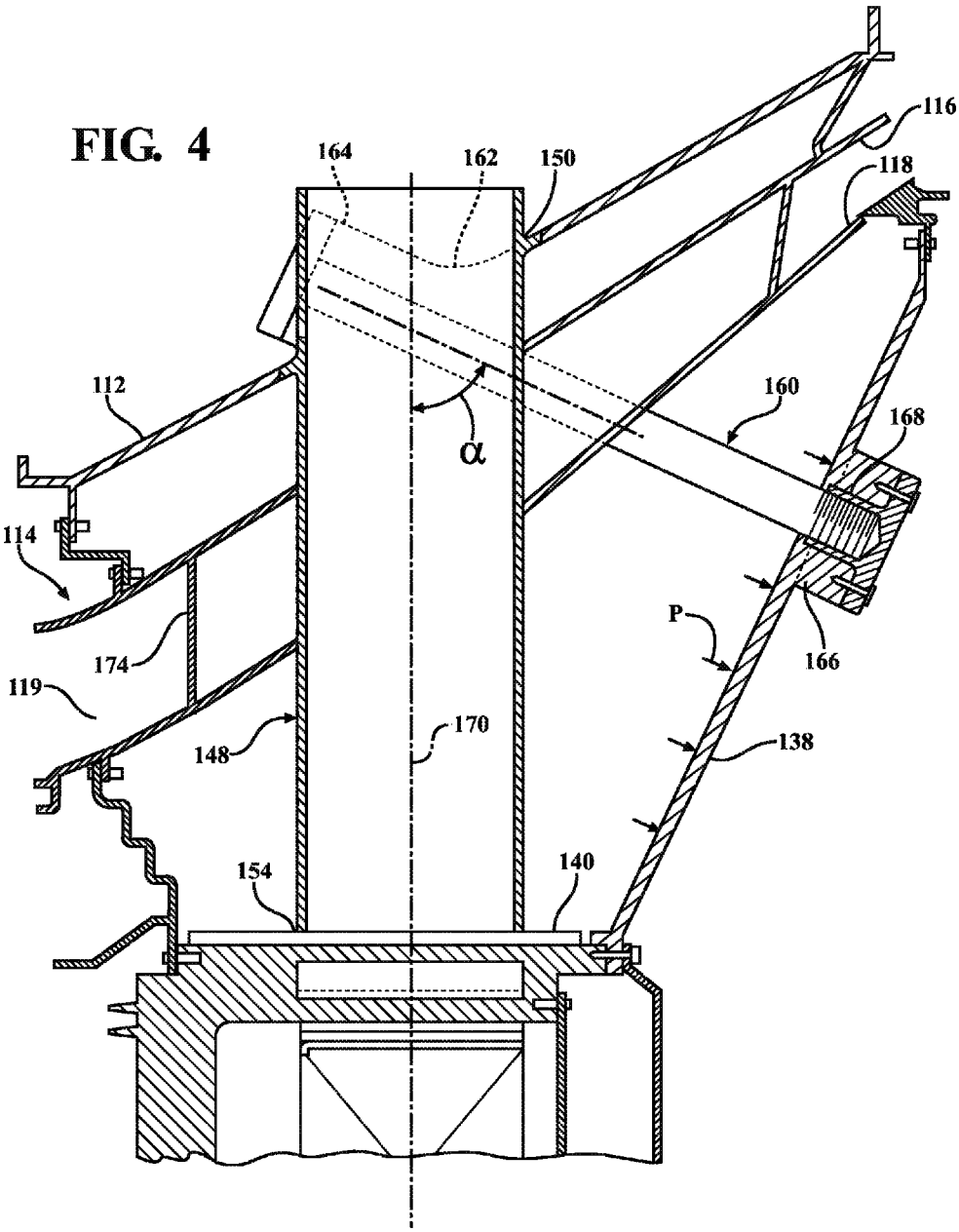
FIG. 4 illustrates an alternative support structure according to a further aspect of the present invention.

Referring to FIG. 4, a further aspect of the invention is illustrated in which elements corresponding to elements of FIG. 3 are labeled with the same reference numeral increased by 100, and in which only the changes from the structure of FIG. 3 are described in detail.

FIG. 4 illustrates an inner structure 114 for an engine, such as the engine 10 illustrated in FIG. 1, including outer and inner walls 116, 118 defining a flow path 119, and an annular structure, such as a diaphragm 138, extending radially between the inner wall 118 and a bearing housing compartment 140. A plurality of radial support members 148 comprising structural support struts may be provided for supporting the bearing housing compartment 140. The radial support members 148 each include a radially outer mount connection 150 rigidly affixed to the outer casing 112, such as by welding, and a radially inner mount connection 154 rigidly affixed to the bearing housing compartment 140, such as by welding.

A plurality of circumferentially spaced axial support members 160 may comprise tie rods extending at an angle radially and axially inwardly from the outer casing 112 to the diaphragm 138. The axial support members 160 may be rigidly affixed to the outer casing 112 at an axially forward mount connection 162, and an opposite end of the axial support members 160 may be rigidly affixed to the diaphragm 138 at an axially rearward mount connection 166. The mount connections 162, 166 may comprise respective detachable threaded connections, such as threaded fastener connections 164, 168, similar to those described for the structure of FIG. 3 and as described, for example, with reference to FIGS. 5A-C.

The radial support members 148 and axial support members 160 may be located within a housing or aerodynamic fairing 174, as described for the support members 48, 60 with reference to FIG. 3. Further, the axially forward mount connections 162 of the axial support members 160 may be generally located at an intersection of the imaginary surface of revolution 170 with the outer casing 112. That is, the imaginary surface of revolution 170 passing through the axial centers of the radial support members 148 may intersect the outer casing 112 at substantially the same axial location as an intersection of the axial support members 160 with outer casing 112.

It should be noted that connection structure, other than the connection structure specifically described herein, may be provided at the ends the axial support members 60, 160 described herein, to the extent that such connection permits detachable assembly of the diaphragm 38, 138 to the respective inner structure 14, 114, such as by detachment of at least one end of the axial support members 60, 160 from the respective inner structure 14, 114.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In a gas turbine engine having structure defining an annular flow path including an inner annular wall and an outer annular wall, a casing for housing the structure, and a bearing compartment housing a rotor shaft bearing located radially inwardly from the inner annular wall, a support structure comprising:

a plurality of circumferentially spaced radial support members extending radially inwardly from an outer mount connection at the casing to an inner mount connection at the bearing compartment housing, the radial support members providing structural support for radial bearing loads on the rotor shaft bearing;

a plurality of circumferentially spaced axial support members extending radially and axially inwardly from an outer mount connection at the casing to an inner mount connection located on an annular structure extending radially between connection locations at the bearing compartment housing and the inner annular wall.

2. The support structure of claim 1, wherein the radial support members comprise tie rods releasably attached to the casing and to the bearing compartment housing.

3. The support structure of claim 1, wherein the radial support members comprise support struts rigidly affixed to the casing and to the bearing compartment housing.

4. The support structure of claim 1, wherein the axial support members comprise tie rods including fastener connections retaining ends of the axial support members to the casing and to the bearing compartment housing.

5. The support structure of claim 1, wherein the axial support members extend from the casing at an angle directed rearwardly relative to the radial support members.

6. The support structure of claim 5, wherein the radial support members define an imaginary surface of revolution extending around the axis of the engine, and the axial support members intersect the surface of revolution at a location adjacent to the casing.

7. The support structure of claim 6, wherein the axial support members intersect the surface of revolution at a location radially inwardly from the casing.

8. The support structure of claim 1, including a plurality of aerodynamic vanes extending between the outer annular wall and the inner annular wall, wherein at least one of each of the radial and axial support members are enclosed within each of the vanes.

9. The support structure of claim 1, wherein the annular structure extending radially between connection locations at the bearing compartment housing and the inner annular wall comprises a substantially continuous annular wall defining a diaphragm separating a higher pressure turbine section of the engine from a lower pressure section of the engine.

10. The support structure of claim 9, wherein the axial support members engage the diaphragm at a location to resist axial pressure forces exerted against the diaphragm.

11. In a gas turbine engine having structure defining an annular flow path including an inner annular wall and an outer annular wall, a casing for housing the structure, and a bearing compartment housing a rotor shaft bearing located radially inwardly from the inner annular wall, a support structure comprising:

a plurality of circumferentially spaced radial support members extending radially inwardly from an outer mount connection at the casing to an inner mount connection at the bearing compartment housing, the radial support members providing structural support for radial bearing loads on the rotor shaft bearing;

a plurality of circumferentially spaced axial support members extending radially and axially inwardly from an outer mount connection at the casing to an inner mount connection located on a diaphragm extending radially between connection locations at the bearing compartment housing and the inner annular wall, the axial support members comprising tie rods operating in tension to counteract a pressure force applied against the diaphragm.

12. The support structure of claim 11, wherein the radial support members comprise tie rods releasably attached to the casing and to the bearing compartment housing.

13. The support structure of claim 11, wherein the radial support members comprise support struts rigidly affixed to the casing and to the bearing compartment housing.

14. The support structure of claim 11, wherein the axial support members comprise fastener connections retaining ends of the tie rods to the casing and to the bearing compartment housing.

15. The support structure of claim 11, wherein the axial support members extend from the casing at an angle directed rearwardly relative to the radial support members.

16. The support structure of claim 15, wherein the radial support members define an imaginary surface of revolution extending around the axis of the engine, and the axial support members intersect the surface of revolution at a location adjacent to the casing.

17. The support structure of claim 16, wherein the axial support members intersect the surface of revolution at a location radially inwardly from the casing.

18. The support structure of claim 16, including a plurality of aerodynamic vanes extending between the outer annular wall and the inner annular wall, wherein at least one of each of the radial and axial support members are enclosed within each of the vanes.

19. The support structure of claim 11, wherein the diaphragm is provided to separate a higher pressure turbine section of the engine from a lower pressure section of the engine.

20. The support structure of claim 19, wherein the axial support members engage the diaphragm at a location between the bearing compartment housing and the inner annular wall to resist axial pressure forces exerted against the diaphragm.

* * * * *